US006324873B1

(12) United States Patent
Sangiacomo

(10) Patent No.: US 6,324,873 B1
(45) Date of Patent: Dec. 4, 2001

(54) CYLINDER WITH ROTATING TUBE FOR GUIDING ARTICLES MANUFACTURED ON CIRCULAR KNITTING MACHINES

(75) Inventor: Fulvio Sangiacomo, Brescia (IT)

(73) Assignee: Sangiacomo S.p.A. (IT)

( * ) Notice: Subject to any disclaimer, the term of this patent is extended or adjusted under 35 U.S.C. 154(b) by 0 days.

(21) Appl. No.: 09/677,628

(22) Filed: Oct. 3, 2000

(30) Foreign Application Priority Data

Nov. 5, 1999 (IT) ..... BS99U0104

(51) Int. Cl.[7] ..... D04B 15/92
(52) U.S. Cl. ..... 66/149 S; 66/151
(58) Field of Search ..... 66/147, 149 R, 66/150, 151, 152, 153, 149 S

(56) References Cited

U.S. PATENT DOCUMENTS

| | | | | |
|---|---|---|---|---|
| 3,550,403 | * | 12/1970 | Shields | 66/147 |
| 3,564,875 | * | 2/1971 | Foreman | 66/147 |
| 3,823,582 | * | 7/1974 | Butler | 66/147 |
| 4,242,891 | * | 1/1981 | Gradi | 66/149 S |
| 5,235,825 | * | 8/1993 | Turini | 66/149 S |
| 5,284,033 | * | 2/1994 | Lonati et al. | 66/149 S |
| 5,560,225 | * | 10/1996 | Salucci | 66/149 S |
| 6,089,050 | * | 7/2000 | Piceni et al. | 66/168 |

* cited by examiner

*Primary Examiner*—Danny Worrell
(74) *Attorney, Agent, or Firm*—McGlew and Tuttle, P.C.

(57) ABSTRACT

A cylinder for circular knitting machines having, internally, a coaxial tube (11) rotating with the cylinder and comprising a rotatable device for guiding the knitted article during the manufacturing phase. Thus, the article, rotating together with the cylinder and with the guide tube, does not undergo twisting or folding during its manufacture.

6 Claims, 1 Drawing Sheet

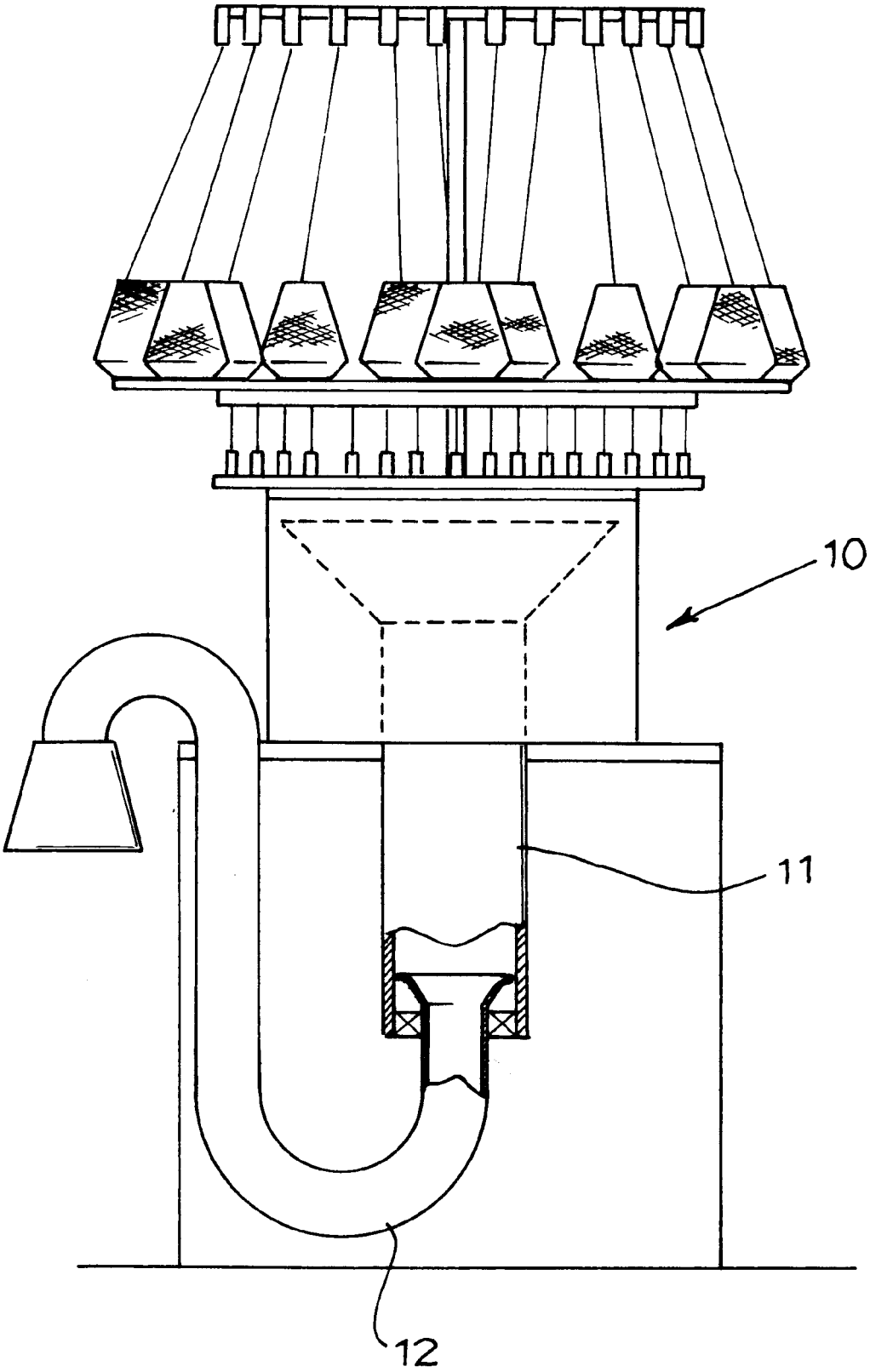
10
11
12

CYLINDER WITH ROTATING TUBE FOR GUIDING ARTICLES MANUFACTURED ON CIRCULAR KNITTING MACHINES

FIELD OF THE INVENTION

The present invention pertains to circular knitting machines and it pertains in particular to a device for guiding the article during the manufacturing phase on such machines.

BACKGROUND OF THE INVENTION

During their manufacture on circular knitting machines, the knitted articles rotate with the needle cylinder of the machine and they can be forced, being drawn from the bottom, to drop into a guide tube that is coaxial to the cylinder. When provided, this tube is fixed, and the article will be held back in its rotation against the surface of the tube proper. Therefore, the articles are subject to twisting and the formation offolds. Often then, the folds that are formed during the manufacture of the knitted article also remain afterwards, detracting from the results of the subsequent treatments to which the article will be subjected.

SUMMARY AND OBJECTS OF THE INVENTION

The object of the present invention is to remedy such a drawback by means of setting up the circular knitting machine so as to make possible a reliable guiding of the article being manufactured without the article having to undergo undue twisting, thus also preventing an undesired formation of folds. The object and the implicit advantages deriving therefrom are accomplished according to the present invention with a guide tube arranged coaxially to the cylinder and rotating together with same.

Therefore, with the progression of its manufacture, the article, which rotates with the needle cylinder, descends into, and rotates in agreement with same, the guide tube which is forced to rotate together with the cylinder.

Thus, there is relatively no rotating movement between article and guide tube, preventing in this manner twisting and/or formations of folds in the article.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

The only FIGURE is a schematic view showing the circular knitting machine cylinder according to the present invention.

DESCRIPTION OF THE PREFERRED EMBODIMENT

Referring to the drawings in particular, the invention comprises a needle cylinder 10 of a circular knitting machine and a guide tube 11. This guide tube 11 is arranged coaxially in the cylinder, fixed thereto and/or controlled to rotate with the cylinder proper. During its manufacture, the article progressively descends, drawn in the usual manner from the bottom by means of a suction device 12, rotating with the needle cylinder 10 and with the tube proper without undergoing twisting or folding.

To better ensure the rotation of the article with the tube, a suctioning device can be provided which is radially connected to the tube so as to attract and maintain the article against the internal surface of the tube, preventing it from sliding with respect to same to the extent possible.

While specific embodiments of the invention have been shown and described in detail to illustrate the application of the principles of the invention, it will be understood that the invention may be embodied otherwise without departing from such principles.

What is claimed is:

1. A circular knitting machine cylinder, comprising:

a needle cylinder element; and a coaxial internal guide tube rotating with said needle cylinder element and comprising an independent device for guiding the knitted article during the phase of manufacture, the knitted article rotating together with said cylinder element and with said guide tube so as not to undergo twisting or folding during its manufacture.

2. A cylinder in accordance with claim 1, wherein said rotating guide tube has an inner contact surface in contact with the article being manufactured during use.

3. A cylinder in accordance with claim 1, further comprising a suctioning device wherein said rotating guide tube is independent of said suctioning device and is connected to said suctioning device.

4. A cylinder in accordance with claim 2, further comprising a suctioning device wherein said rotating guide tube is independent of said suctioning device and is connected to said suctioning device.

5. A cylinder in accordance with claim 1, wherein said guide tube is fixed to said cylinder.

6. A circular stocking knitting machine comprising:

a cylinder;

a coaxial internal guide tube rotating with and fixed to said cylinder element and comprising a rotatably mounted device for guiding the knitted article during the phase of manufacture, said article rotating together with said cylinder element and with said guide tube so as not to undergo twisting or folding during its manufacture; and a suctioning device wherein said rotating guide tube is an independent component connected to said suctioning device.

* * * * *